United States Patent [19]

Yatabe et al.

[11] Patent Number: 4,751,906

[45] Date of Patent: Jun. 21, 1988

[54] AIR-FUEL RATIO CONTROL METHOD FOR INTERNAL COMBUSTION ENGINES

[75] Inventors: Fumio Yatabe; Yoshio Wazaki, both of Wako, Japan

[73] Assignee: Honda Giken Kogyo K.K., Tokyo, Japan

[21] Appl. No.: 908,336

[22] Filed: Sep. 17, 1986

[30] Foreign Application Priority Data

Sep. 19, 1985 [JP] Japan ..... 60-207291

[51] Int. Cl.[4] ..... F02M 51/00

[52] U.S. Cl. ..... 123/489; 123/440; 123/486; 123/436

[58] Field of Search ..... 123/489, 440, 480, 486, 123/487, 436, 589

[56] References Cited

U.S. PATENT DOCUMENTS

| | | | |
|---|---|---|---|
| 4,584,979 | 4/1986 | Fujimura et al. | 123/589 |
| 4,592,325 | 6/1986 | Nakagawa | 123/489 |
| 4,601,809 | 6/1986 | Kitahara | 123/489 |
| 4,608,956 | 9/1986 | Katoh et al. | 123/489 |
| 4,644,921 | 2/1987 | Kobayashi et al. | 123/489 |
| 4,646,699 | 5/1987 | Yasuoka et al. | 123/489 |

*Primary Examiner*—Raymond A. Nelli

*Attorney, Agent, or Firm*—Arthur L. Lesler

[57] ABSTRACT

A method of effecting feedback control of the air-fuel ratio of an air-fuel mixture supplied to an internal combustion engine to a first predetermined value, by correcting a basic fuel supply quantity by the use of a correction coefficient variable in response to the output of an exhaust gas ingredient concentration sensor, when the engine is operating in a predetermined feedback control region. A predetermined engine low-load operating region outside the predetermined feedcback control region is defined by at least one parameter representing load on the engine. When the engine enters the predetermined low-load operating region, the correction coefficient is gradually decreased until the air-fuel ratio of the air-fuel mixture is increased to a second predetermined value leaner than the first predetermined value. When the engine enters the predetermined feedback control region from the predetermined low-load operating region, the initial value of the correction coefficient is set to the product of a value of the correction coefficient obtained immediately before the engine enters the predetermined feedback control region and a predetermined enriching coefficient, and the set initial value is gradually increased until the air-fuel ratio of the air-fuel mixture is decreased to the first predetermined value.

5 Claims, 7 Drawing Sheets

V=VLS ?
TW>TWLS ?
TA>TALS ?
PB<PBLS3H ?
PB>PBLS3L ?
Ne<NLS3H ?
Ne>NLS3L ?
FLAGLS3=0 ?
SET NXLS VALUE TO 0
WAS OPEN LOOP CONTROL EFFECTED IN PRECEDING LOOP ?
FLAGLS3=1 ?
FLAGLS3=2 ?
IS ENGINE IN MIXTURE LEANING REGION ?
FLAGLS3≧2 ?
TDLS = 0
KO2 = CRI x KREF
KLS = 1.0
FLAGLS3 = 0
KLS LOOP
Yes
No
TO 13
TO 16
TO 25
TO 31
TO 39

AIR-FUEL RATIO CONTROL METHOD FOR INTERNAL COMBUSTION ENGINES

BACKGROUND OF THE INVENTION

This invention relates to a control method of controlling the air-fuel ratio of an air-fuel mixture being supplied to an internal combustion engine for automotive vehicles, and more particularly to a method of this kind which facilitates smooth transition of engine operating condition between a feedback control region and a mixture-leaning region.

An air-fuel ratio control method for an internal combustion engine is generally known wherein the fuel quantity supplied to the engine is controlled in a feedback manner responsive to an air-fuel ratio correction value set based on an output signal from an exhaust gas sensor which detects the concentration of an exhaust gas ingredient, in order that the air-fuel ratio of the mixture supplied to the engine becomes equal to a desired ratio (e.g. the stoichiometic mixture ratio).

It is also known e.g. from Japanese Provisional Patent Publication (Kokai) No. 59-539 to provide mixture-leaning regions which are defined by engine operation parameters (e.g. vehicle speed, engine coolant temperature, intake pipe absolute pressure, engine rotational speed), and control the air-fuel ratio of the mixture supplied to the engine to a value larger or leaner than the stoichiometric mixture ratio (14.7) while interrupting the feedback control when the engine is operating in any of the mixture-leaning regions, to thereby reduce the fuel consumption.

However, in conventional methods, when the engine operating condition changes from a feedback control region where the air-fuel ratio of the mixture is controlled to the stoichiometric ratio (14.7), to a mixture-leaning region where the air-fuel ratio is controlled to a value leaner than the stoichiometric ratio, the air-fuel ratio is suddenly changed to a value leaner than the stoichiometric ratio so that the engine torque undergoes a sudden change to thereby cause degradation of the driveability. Also, when the engine operating condition changes from a mixture-leaning region to the feedback control region, the same problem occurs due to a sudden change in the air-fuel ratio from the value leaner than the stoichiometric ratio to the stoichimetric ratio.

SUMMARY OF THE INVENTION

It is the object of the invention to provide an air-fuel ratio control method for an internal combustion engine for automotive vehicles, which is capable of preventing a sudden change in engine torque attributable to a sudden change in the air-fuel ratio which occur when the engine operating condition shifts from a feedback control region to a mixture-leaning region as well as when the engine operating condition shifts from a mixture-leaning region to a feedback control region, to thereby improve the driveability, and in the latter case, also capable of smoothly and promptly effecting the shifting of the engine operating condition to the feedback control region to prevent degradation of the emission characteristics as well as improve the driveability.

The present invention provides a method of effecting feedback control of the air-fuel ratio of an air-fuel mixture being supplied to an internal combustion engine having an exhaust passage and means arranged in the exhaust passage for detecting the concentration of an exhaust gas ingredient, to a first predetermined value, by correcting a basic fuel supply quantity by the use of a correction coefficient variable in value in response to an output from the means for detecting the exhaust gas ingredient concentration, when the engine is operating in a predetermined feedback control region, the method comprising the steps of: (1) providing a low-load operating region of the engine lying outside the predetermined feedback control region and defined by at least one parameter representing load on the engine; (2) gradually decreasing the correction coefficient until the air-fuel ratio of the air-fuel mixture is increased to a second predetermined value which is leaner than the first predetermined value, when the engine enters the predetermined low-load operating region; (3) when the engine enters the predetermined feedback control region from the predetermined low-load operating region, setting an initial value of the correction coefficient to the product of a value of the correction coefficient obtained immediately before the engine enters the predetermined feedback control region and a predetermined enriching coefficient; and (4) gradually increasing the initial value of the correction coefficient until the air-fuel ratio of the air-fuel mixture is decreased to the first predetermined value.

Preferably, in the step (2) the value of the correction coefficient is gradually decreased to a target value which yields a predetermined air-fuel ratio richer than a stoichiometric mixture ratio, and the step (3) is executed to set the initial value of the correction coefficient to the product of the value of the correction coefficient obtained immediately before the engine enters the predetermined feedback control region and the predetermined enriching coefficient only when the value of the correction coefficient obtained immediately before the engine enters the predetermined feedback control region is equal to the target value.

The above and other objects, features and advantages of the invention will be more apparent from the ensuing detailed description taken in conjunction with the accompanying drawings.

DETAILED DESCRIPTION

The invention will now be described in detail with reference to the drawings illustrating an embodiment thereof.

Figure 1:
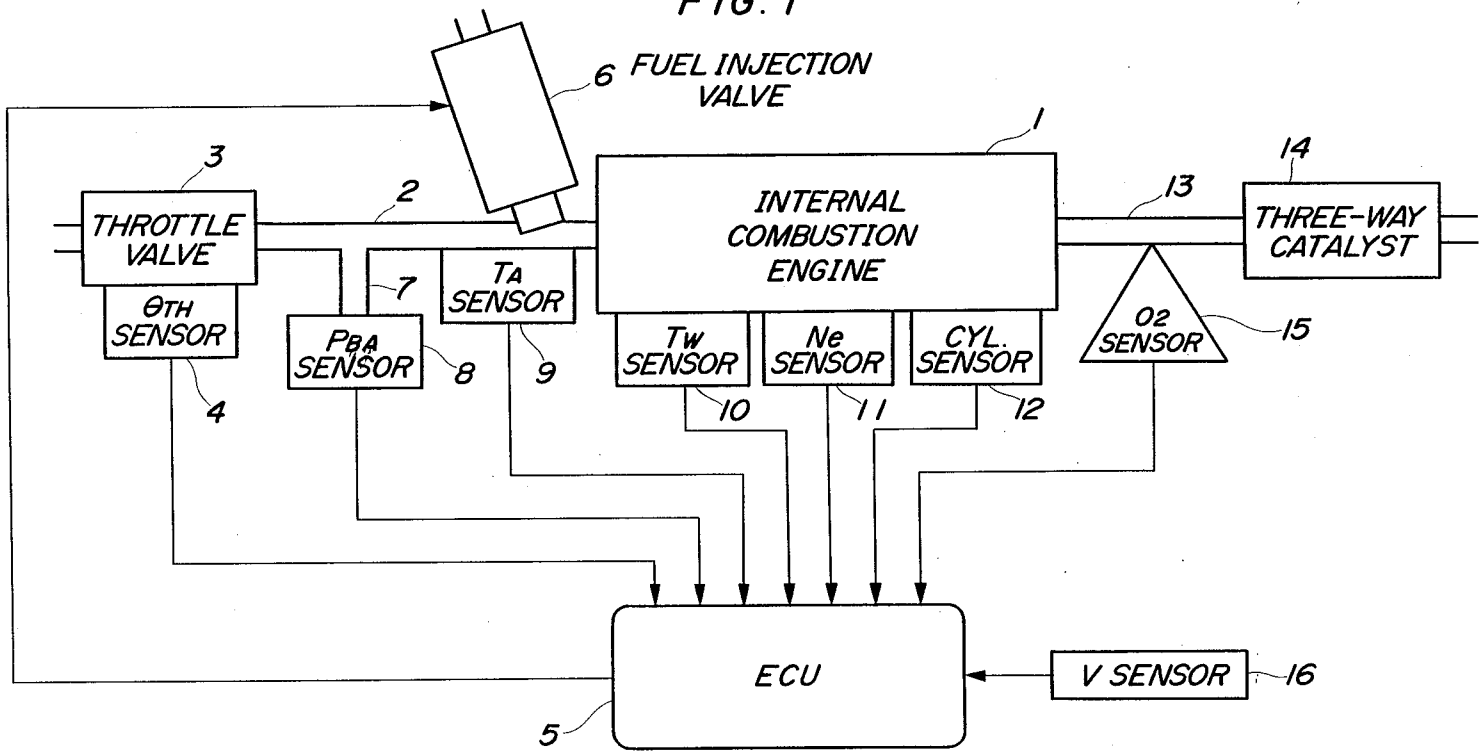
FIG. 1 is a block diagram illustrating the whole arrangement of a fuel supply control system to which is applied the air-fuel ratio control method according to the invention.

Referring first to FIG. 1, there is illustrated the whole arrangement of a fuel supply control system for internal combustion engines, to which the method of the invention is applied. Reference numeral 1 designates an internal combustion engine which may be a four-cylinder type, for instance. Connected to the engine 1 is an intake pipe 2, in which is arranged a throttle valve 3, to which is coupled a throttle valve opening sensor 4 for detecting the throttle valve opening θTH and supplying an electrical signal indicative thereof to an electronic control unit (hereinafter called "the ECU") 5, which executes programs for controlling the air-fuel ratio, etc. as described later.

Fuel injection valves 6, one for each cylinder, are arranged in the intake pipe 2 at a location between the engine 1 and the throttle valve 3. These injection valves 6 are connected to a fuel pump, not shown, and also electrically connected to the ECU 5 in a manner having their valve opening periods or fuel injection quantities controlled by driving signals supplied from the ECU 5.

On the other hand, an intake pipe absolute pressure sensor 8 is connected to the intake pipe 2 such that it communicates through a conduit 7 with the interior of the intake pipe 2 at a location between the throttle valve 3 and the fuel injection valves 6. The absolute pressure sensor 8 is adapted to detect absolute pressure PB in the intake pipe 2 via the conduit 7 and supplies an electrical signal indicative of detected absolute pressure to the ECU 5. An intake air temperature sensor 9 for detecting intake air temperature TA is arranged in the intake pipe 2 at a location between the conduit 7 and the fuel injection valves 6, and is also electrically connected to the ECU 5 for supplying same with an electrical signal indicative of detected intake air temperature.

An engine coolant temperature sensor 10, which may be formed of a thermistor or the like, is embedded in the peripheral wall of an engine cylinder having its interior filled with cooling water, to detect engine cooling water temperature TW. An electrical output signal indicative of detected engine cooling water temperature is supplied to the ECU 5.

An engine rotational angle position sensor 11 (hereinafter called "the Ne sensor") and a cylinder-discriminating (CYL) sensor 12 are arranged in facing relation to a camshaft, not shown, of the engine 1 or a crankshaft, not shown, of same. The former 11 is adapted to generate one pulse at each of particular crank angles of the engine each time the engine crankshaft rotates through 180 degrees, as a top-dead-center position (TDC) signal, while the latter 12 is adapted to generate one pulse of a cylinder-discriminating signal at a particular crank angle of a particular engine cylinder. The above pulses generated by the sensors 11, 12 are supplied to the ECU 5.

A three-way catalyst 14 is arranged in an exhaust pipe 13 extending from the engine 1 for purifying ingredients HC, CO, and NOx contained in the exhaust gases. An $O_2$ sensor 15 is inserted in the exhaust pipe 13 at a location upstream of the three-way catalyst 14 for detecting the concentration of oxygen (02) in the exhaust gases and supplying an electrical signal indicative of the detected oxygen (02) concentration value to the ECU 5.

Further connected to the ECU 5 are other engine operation parameter sensors, e.g. a vehicle speed sensor 16, for supplying electrical signals indicative of detected values of their respective operation parameters to the ECU 5.

The ECU 5 determines operating regions wherein the engine is operating, e.g. low-load operating regions where the air-fuel mixture is to be made leaner, and calculates, in synchronism with inputting of the TDC signal to the ECU, a fuel injection period TOUT based on various engine operation parameter signals inputted to the ECU 5 as stated above, by the use of the following equation:

$$TOUT = Ti \times KO2 \times KLS \times K1 + K2 \ldots \quad (1)$$

where Ti represents a basic value of the fuel injection period of the fuel injection valves 6 which is determined as a function of engine speed Ne detected by the Ne sensor 11 and intake pipe absolute pressure PB detected by the intake pipe absolute pressure sensor 8, and KO2 an air-fuel ratio correction coefficient which is determined based on oxygen concentration detected by the 02 sensor 15 during air-fuel ratio feedback control or determined in a manner hereinafter described during air-fuel ratio open loop control. KLS is a mixture-leaning coefficient which is set to predetermined values in a manner hereinafter described when the engine is in predetermined leaning operating regions. K1 and K2 are other correction coefficients and correction variables, respectively, which are calculated as functions of engine operation parameter values detected by various sensors mentioned before, namely throttle valve opening sensor 4, intake pipe absolute pressure sensor 8, intake air temperature sensor 9, engine coolant temperature sensor 10, Ne sensor 11, cylinder discriminating sensor 12, 02 sensor 15, and vehicle speed sensor 16, by the use of respective predetermined equations to such values as to optimize various operating characteristics of the engine such as startability, emission characteristics, fuel consumption, and accelerability.

The ECU 5 supplies the fuel injection valves 6 with driving signals corresponding to the fuel injection period TOUT obtained through the equation (1), to thereby open the fuel injection valves 6 over the valve opening period.

Figure 2:
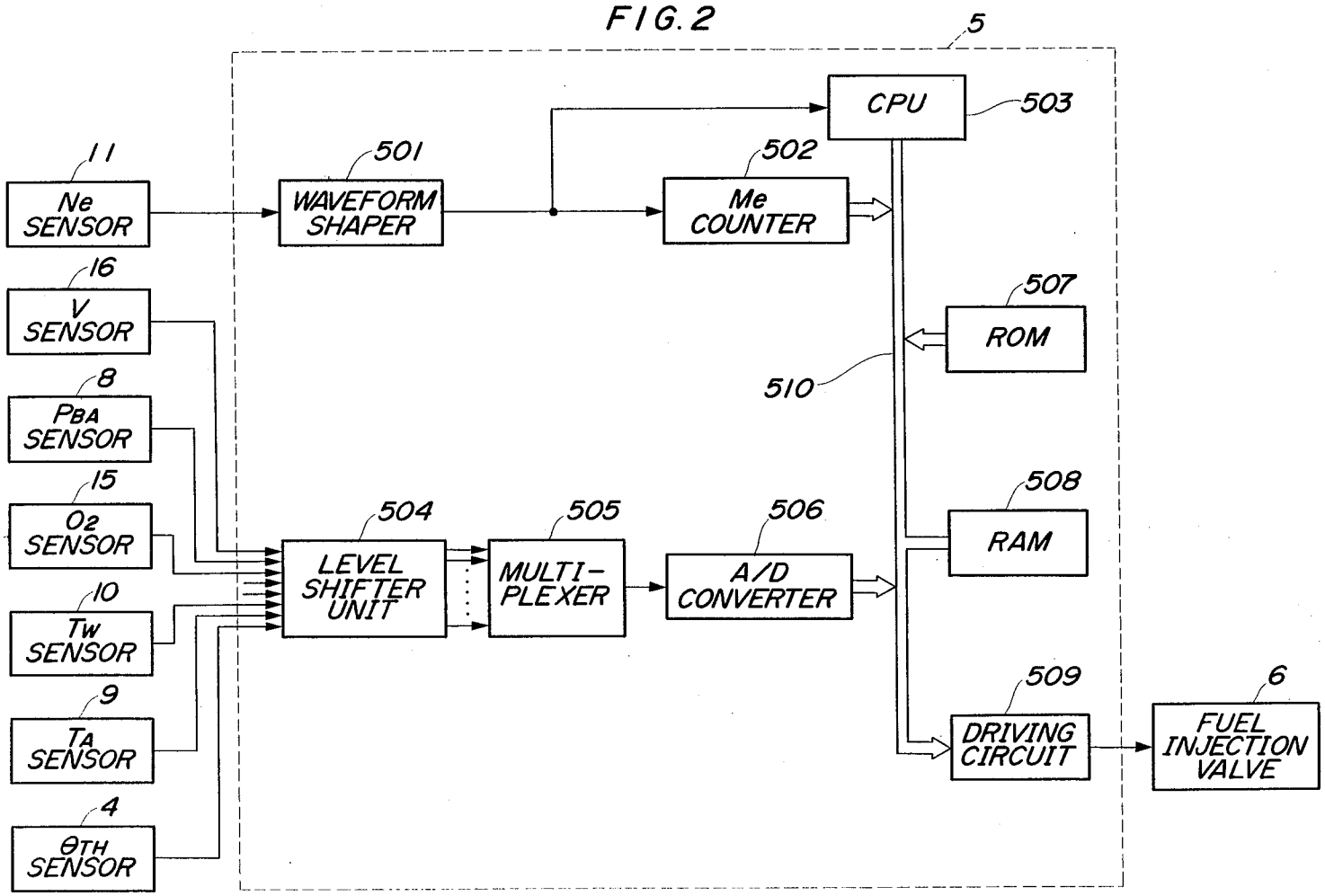
FIG. 2 is a block diagram illustrating the internal arrangement of an electronic control unit (ECU) appearing in FIG. 1.

FIG. 2 shows a circuit arrangement within the ECU 5 in FIG. 1. A TDC signal from the Ne sensor 11 in FIG. 1 is applied to a waveform shaper 501, wherein it has its pulse waveform shaped, and supplied to a central processing unit (hereinafter called "the CPU") 503, as well as to an Me counter 502. The Me counter 502 counts the interval of time between a preceding pulse of the TDC signal and a present pulse thereof, and therefore its counted value Me is proportional to the reciprocal of the actual engine speed Ne. The Me counter 502 supplies the counted value Me to the CPU 503 via a data bus 510.

The respective output signals from various sensors shown in FIG. 1, such as throttle valve opening sensor 4, intake pipe absolute pressure sensor 8, intake air temperature sensor 9, engine coolant temperature sensor 10, and 02 sensor 15 have their voltage levels shifted to a predetermined voltage level by a level shifter unit 504 and then successively applied to an A/D (analog-to-digital) converter 506 through a multiplexer 505.

The A/D converter 506 successively converts the analog output signals from the aforementioned various sensors into digital signals, and the resulting digital signals are supplied to the CPU 503 via the data bus 510.

Further connected to the CPU 503 via the data bus 510 are a read-only memory (hereinafter called "the ROM") 507, a random access memory (hereinafter called "the RAM") 508 and a driving circuit 509. The RAM 507 stores various programs to be executed within the CPU 503, a PB-Ne-Ti map from which the basic fuel injection period Ti is selected, and other various data and tables. The RAM 508 temporarily stores the results of calculations executed within the CPU 503, and other data such as ones read from the Me counter 502 and the A/D converter 506. The driving circuit 509 supplies driving signals corresponding to the fuel injection period TOUT calculated by the equation (1) to the fuel injection valves 6 to drive same.

Figure 3:
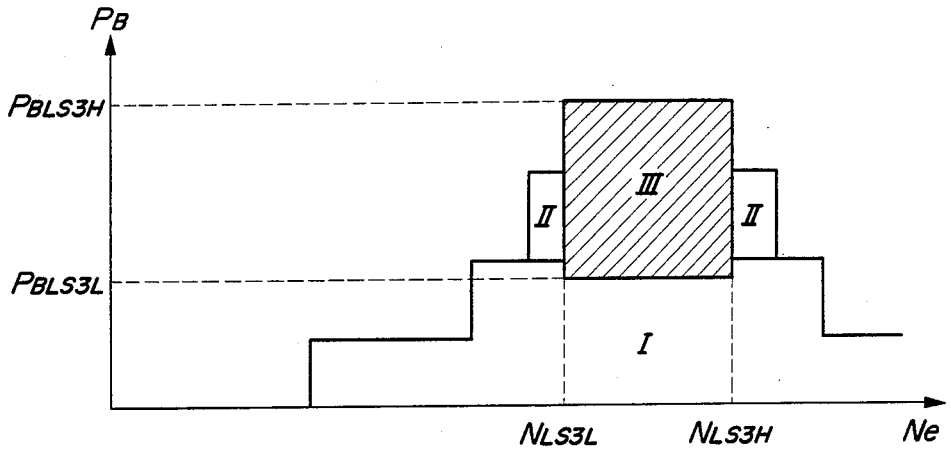
FIG. 3 is a graph showing a mixture-leaning operating region.

Referring to FIG. 3, mixture-leaning regions of the engine are shown, which comprise three regions I, II, and III, divided by the engine rotational speed Ne and the intake pipe absolute pressure PB. The mixture-leaning coefficient KLS is applied as the engine enters these regions. In these mixture-leaning regions, whether or not to effect mixture-leaning is decided based on the speed V of a vehicle in which the engine is installed, the engine coolant temperature TW, and the engine intake air temperature TA. For example, the region III (low load, high speed operating region) is a region where NLS3L<Ne<NLS3H and PBLS3L<PB<PBLS3H hold, and mixture-leaning is effected only when the following conditions are satisfied: V>VLS (e.g 45 km/h), TW>TWLS (e.g. 70° C.), TA>TALS (e.g. 20° C.). The region III corresponds to the vehicle's high speed cruising.

When the engine is in the mixture-leaning region I, the mixture-leaning correction coefficient KLS is set to a predetermined value XLS1 (e.g. 0.90), and when the engine is in the mixture-leaning region II, the coefficient KLS is set to a predetermined value XLS2 (e.g. 0.85), so that the mixture is leaned to air-fuel ratios suitable to the respective regions.

In the regions I and II, the air-fuel ratio correction coefficient KO2 is set to a value KREF which is an average of values of KO2 obtained while the engine was in air-fuel ratio feedback region (not shown) which lie outside the regions I, II, III. In the region III (the low load, high speed operating region), the mixture-leaning coefficient KLS is set to 1.0 and the air-fuel ratio correction coefficient KO2 is calculated by the following equation:

$$KO2 = KO2AVE \times XLS3 = KO2LLM \ldots \quad (2)$$

where KO2AVE is an average of values of the air-fuel ratio correction coefficient KO2 set in accordance with the feedback control which is effected over a predetermined time period after the engine enters the region III. XLS3 (e.g. 0.80) is a mixture-leaning coefficient. KO2 calculated by the equation (2) is applied as KO2LLM, as explained later, KO2LLM being set to such a value as to attain an optimal air-fuel ratio (e.g. 18.0) to improvement of fuel consumption and emission characteristics while the engine is in the region III.

Figure 7:
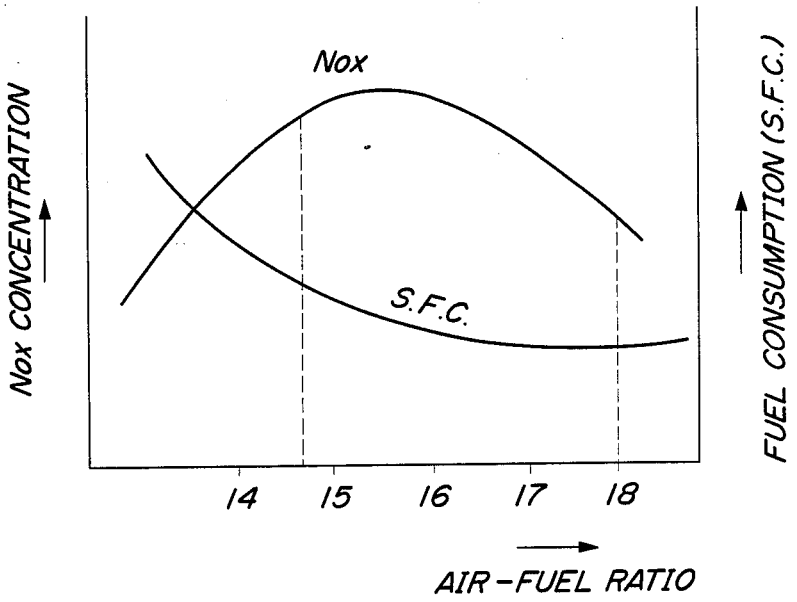
FIG. 7 is a graph showing NOx concentration and fuel consumption plotted with respect to air-fuel ratio.

Referring to FIG. 7, the relationship between NOx concentration and air-fuel ratio, and that between fuel consumption (S.F.C.) and air-fuel ratio will now be explained. It is seen from the figure that the NOx concentration becomes maximum when the air-fuel ratio becomes slightly leaner than 14.7 (at which the conversion efficiency of the three-way catalyst 14 in FIG. 1 becomes maximum), and as the air-fuel ratio is further leaned the NOx concentration decreases. It is clearly seen from FIG. 7 that the optimum value of air-fuel ratio that causes both NOx concentration and fuel consumption to be low and at the same time does not impair driveability is 18.0.

Therefore, it is possible to improve fuel consumption without causing NOx concentration to increase during low-load high speed cruising, if the mixture-leaning coefficient XLS3 is set to such an appropriate value as to obtain a target value KO2LLM of the air-fuel ratio correction coefficient KO2 that makes the air-fuel ratio to be 18.0.

The average value KO2AVEn as of a present pulse of the TDC signal is obtained by the following equation:

$$KO2AVEn = \frac{LREF}{256} \times KO2p + \frac{256 - LREF}{256} \times KO2AVEn - 1 \quad (3)$$

where LREF represents an averaging variable which is set to an integer suitably selected from 1 through 256; KO2p is a value assumed by KO2 either immediately before or after setting of KO2 value by the proportional term (P term) control according to which the O2 feedback coefficient KO2 is increased or added by a fixed value each time the output of the O2 sensor 15 changes across a predetermined value from the rich side to the lean side or vice versa; KO2AVEn-1 represents the average value of KO2 as of the immediately preceding pulse of the TDC signal.

Incidentally, when the engine is in a feedback control region lying outside the mixture-leaning operating regions I, II, III, the air-fuel ratio of the mixture is controlled in closed loop mode, i.e. in a feedback manner responsive to the air-fuel ratio correction coefficient KO2, which varies with the output signal from the 02 sensor 15, such that the air-fuel ratio is controlled to a stoichiometic mixture ratio. On this occasion the mixture-leaning coefficient KLS is set to 1.0.

Figure 4:
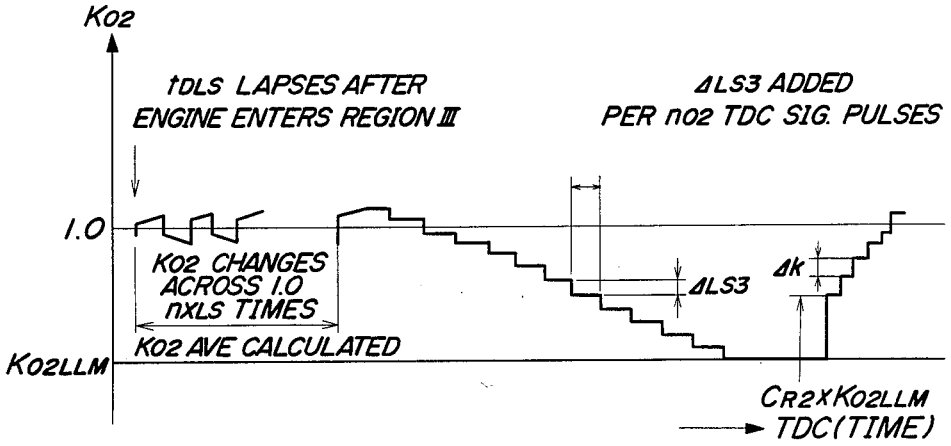
FIG. 4 is a graph showing an example of manner of calculating an air-fuel ratio correction coefficient KO2 in accordance with the method of the invention.
Figures 5, 5A, 5B:
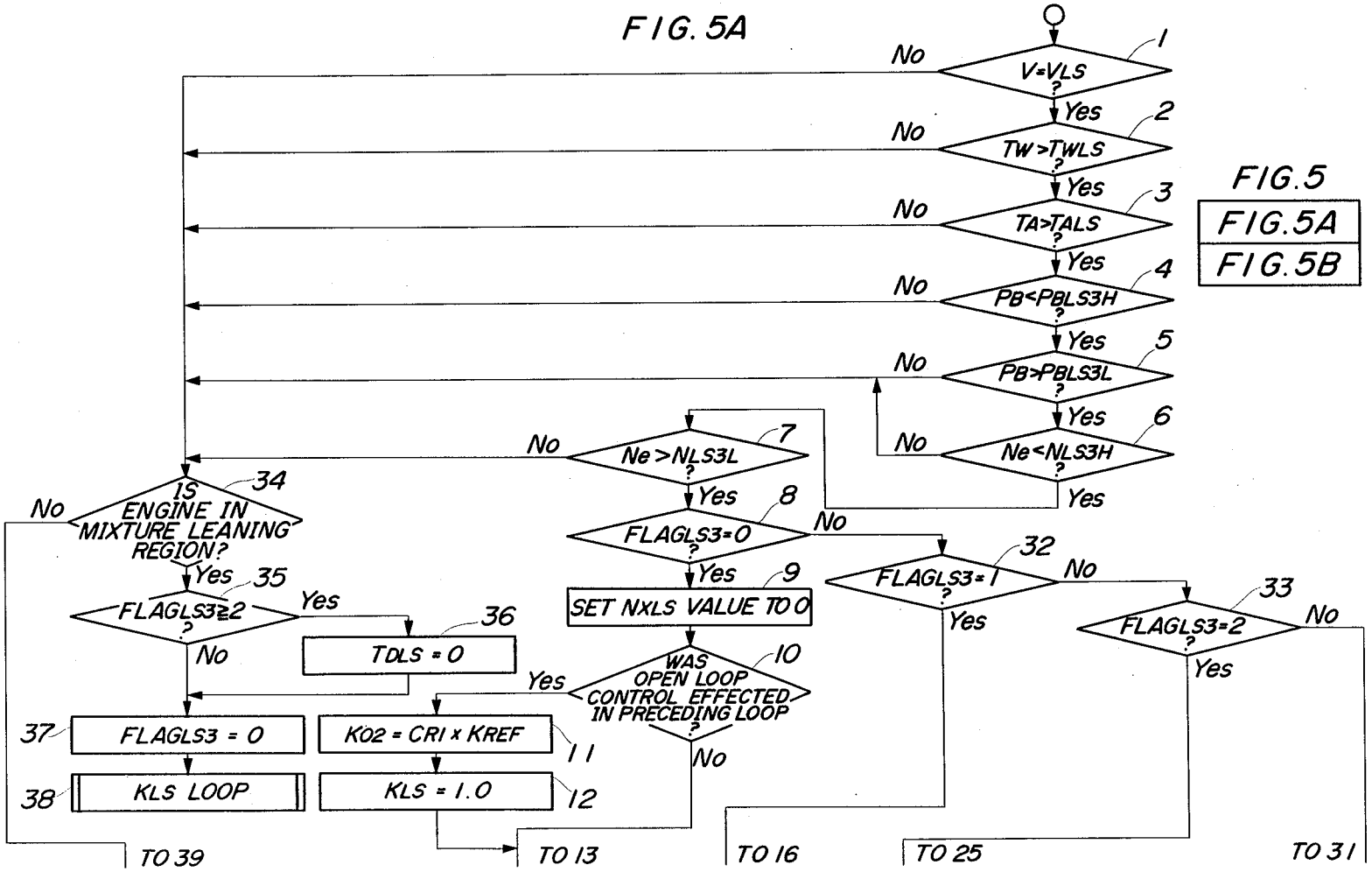
FIGS. 5A and 5B constitutes a flowchart of a program of executing the air-fuel ratio control method according to the invention.
Figure 5B:
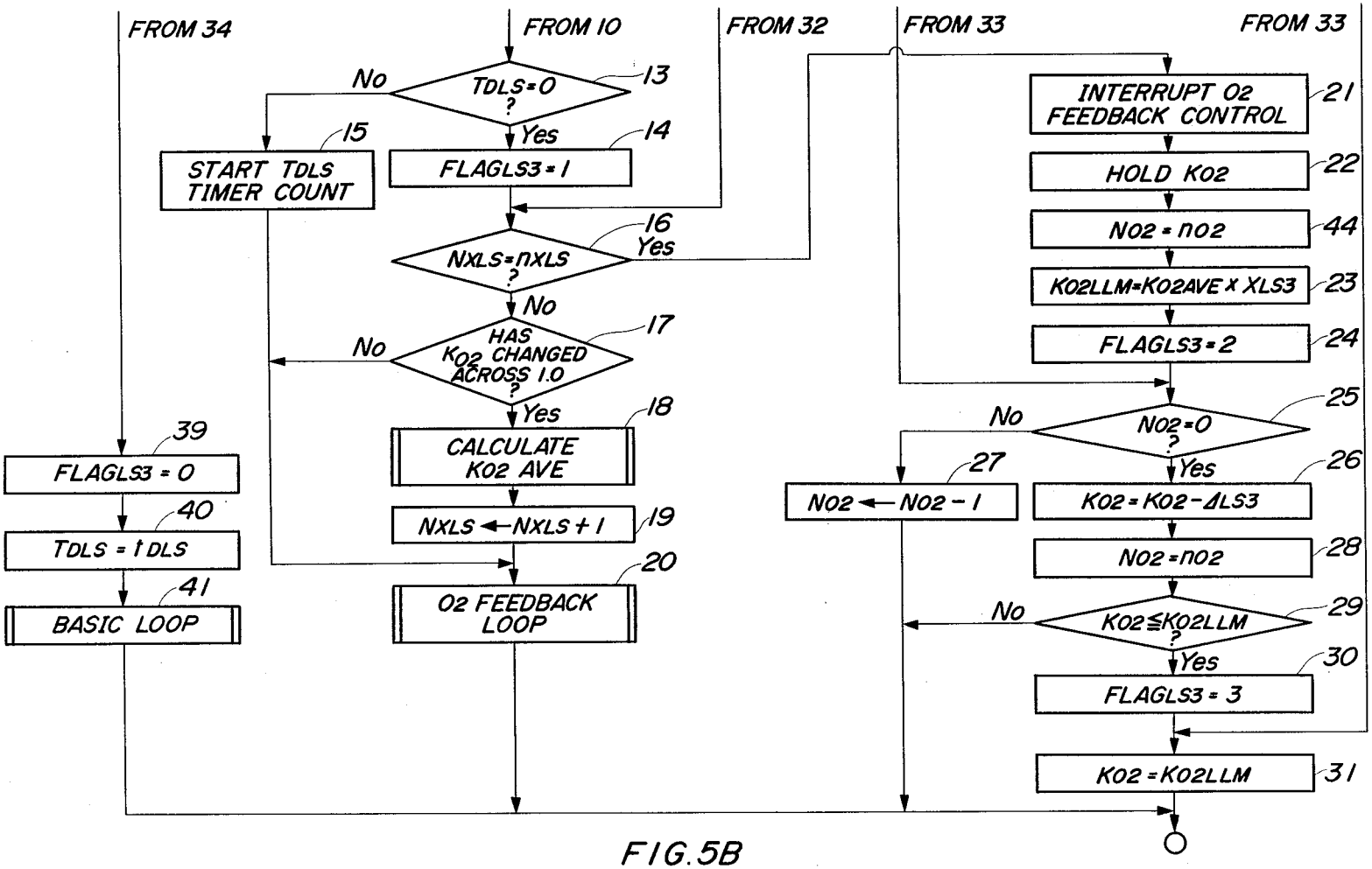

Referring now to FIG. 4 showing variation of the coefficient KO2 and FIG. 5 showing a flow chart of a program executed in synchronism with every TDC signal pulse, the air-fuel ratio control method according to the invention will be explained.

First, steps 1 through 7 in FIG. 5 determine whether or not the engine is operating in the region III (FIG. 3). More specifically, step 1 determines whether the vehicle speed V is higher than a predetermined value VLS (e.g. 45 km/h), and step 2 whether the engine coolant temperature TW is higher than a predetermined value TWLS (e.g. 70° C.). Step 1 is intended to reduce the NOx concentration during cruising on a superhighway where the vehicle speed is normally higher than 45 km/h, by leaning the mixture at vehicle speeds above 45 km/h. Step 2 is intended to improve the engine driveability by preventing leaning of the mixture when the engine is cold (before engine warming is completed). Step 3 determines whether or not the engine intake air temperature TA is higher than a predetermined value TALS (e.g. 20° C.), for the purpose of preventing poor engine combustion caused by leaning of the mixture when the ambient temperature is low, and the resulting degraded driveability. Then, steps 4 and 5 determine whether or not the intake pipe absolute pressure PB satisfies the inequality PBLS3L<PB<PBLS3H, and steps 6 and 7 determine whether the engine rotational speed Ne satisfies the inequality NLS3L<Ne<NLS3H. If any one of the steps 1 through 7 provides a negative answer (No), the program proceeds to step 34 and its succeeding steps to effect air-fuel ratio control in the mixture-leaning regions I and II and other regions including the feedback control region, as described later. If, on the other hand, the questions of all the steps 1 through 7 are affirmatively answered, the engine is judged to be operating in the mixture-leaning region III, and then step 8 and its succeeding steps are executed to effect mixture-leaning control in the region III. More particularly, when the engine is determined to be in the region III, the program executes steps 8 through 31 as follows. The air-fuel ratio feedback control is executed for a predetermined time period TDLS (e.g. 0.5 seconds) after the engine enters the region III. And even after the elapse of the predetermined time period TDLS the feedback control is still continued until the output voltage VO2 of the O2 sensor 15 has changed across a predetermined value from the lean side to the rich side or vice versa a predetermined number of times nXLS, preferably the number of times NXLS the air-fuel ratio correction coefficient KO2 changes across 1.0 has reached the predetermined value nXLS (e.g. 10). During this feedback control following the lapse of the predetermined time period TDLS, the average value KO2AVE of the correction coefficient KO2 obtained during this feedback control is simultaneously calculated by the equation (3). Then, by placing the value of KO2AVE into the equation (2), KO2LLM is obtained, and this value KO2LLM is employed as the target value for the coefficient KO2 to reach while the engine is in the region III.

Once the coefficient KO2LLM is calculated, the value of KO2 is decreased by a fixed value ΔLS3 each time a predetermined number nO2 of TDC signal pulses have been generated, as shown in FIG. 4, so that the value of KO2 gradually approaches the target value KO2LLM. By thus causing the KO2 value, which is set in response to the output signal of the O2 sensor 15, to gradually approach to the target value of KO2LLM instead of suddenly changing the KO2 value to the KO2LLM, it is possible to avoid a sudden change in engine torque attributable to sudden leaning of the mixture and hence to improve the driveability.

On the other hand, when the engine operating condition shifts from the region III to the feedback control region, the product of the target value KO2LLM applied in the region III immediately before the shifting and a predetermined enriching coefficient CR2 is employed as the initial value of the air-fuel correction coefficient KO2 (i.e. KO2=CR2×KO2LLM). Immediately then, the KO2 value is increased by a fixed value Δk each time a predetermined number NI of the TDC signal pulses have been generated, as shown in FIG. 4, so that the KO2 value stepwise approaches a desired value which gives the stoichiometric ratio value. As a result, it is possible to avoid a sudden change in engine torque caused by a sudden shifting of the engine operating condition to the feedback control region. Also, since the product of the correction coefficient KO2LLM applied immediately before the shifting and the predetermined enriching coefficient CR2 is employed as the initial value of KO2, the air-fuel ratio is promptly controlled to the stoichiometric mixture ratio appropriate to the feedback control region, whereby degradation in the driveability and that in emission characteristics can be prevented.

Reverting to FIGS. 5 and 6, the method of the invention will be further explained with reference to the flowcharts shown therein.

If steps 1 through 7, shown in FIG. 5, determine the engine to be operating in the region III, it is determined at step 8 whether or not a flag FLAGLS3 is equal to zero. If the flag FLAGLS3 is zero, it indicates that the engine is in a condition other than those indicated by other values (=2, 3) of the flag wherein the control is to be executed in the region III, as hereinafter described. If the answer to step 8 is Yes, the count value NXLS (the number of times the KO2 value has changed across the predetermined value between the lean side to the rich side) is reset to zero at step 9, and then it is determined at step 10 whether or not the immediately preceding loop was an open loop, i.e. whether or not the engine was in the mixture-leaning region I or II during the immediately preceding loop. If the answer is No, i.e. if the present loop is the first loop immediately after the engine has entered the mixture-leaning region III from the feedback control region, the program directly proceeds to step 13 whereat it is determined whether or not the predetermined time period TDLS has elapsed, i.e. whether or not the count value TDLS of the TDLS downcounter is zero. On the other hand, if the answer at step 10 is Yes, i.e. if the air-fuel ratio was controlled to be to a lean value appropriate to the region I or II during the immediately preceding loop, the product of the average value KREF of values of the coefficient KO2 assumed while the engine was in a feedback region by a mixture-enriching coefficient CR1 is employed as the initial value of the correction coefficient KO2 (step 11), and after setting the mixture-leaning coefficient KLS to 1.0 at step 12 the program proceeds to step 13.

If the answer to the question of step 13 is No, then the count value TDLS is reduced by one at step 15, and only the feedback control that is carried out immediately after the engine enters the region III is continued (step 20), and if the answer to the question of step 13 is Yes, the program proceeds to step 14, where FLAGLS3 is set to 1. FLAGLS3=1 means that the average value KO2AVE of values of the coefficient value KO2 assumed during the feedback control immediately after the engine enters the region III is being calculated. Then, at step 16 it is determined whether or not the number of times NXLS the KO2 value has changed across 1.0 has reached the predetermined value nXLS (e.g. 10). If the answer is No, it is then determined whether or not the KO2 value has changed across 1.0 (step 17). If the answer to the question of step 17 is Yes, the average value KO2AVE is calculated by the equation (3) (step 18), and after increasing the value of NXLS by one (step 19) the feedback contorl in continued (step 20). If the answer to the question of step 17 is No, i.e. if the KO2value has not change acroos 1.0, then only the feedback control specified by step 20 is continued without calculating KO2AVE.

In the next loop, since the flag FLAGS3 has been set to 1 at step 14 in the immediately preceding loop, the answer to the question of step 8 will be No, and therefore the program proceeds to step 32, and than executes steps 16 through 20, wherein the average value KO2AVE is calculated at step 18. When this calculation has been conducted the predetermined number of times NXKS, i.e. the KO2 value has changed across 1.0 the predetermined number of times NXLS, then the feedback control is discontinued (step 21) (refer to FIG. 4), the KO2 value is held at the value then assumed (step 22), a predetermined TDC signal pulse count NO2 is reset to a predetermined value nO2 which is set at 4 if the control is applied to a four stroke cycle engine (step 44), and the air-fuel ratio correction value value KO2LLM is calculated by the equation (3) (step 23). At step 24 the flag FLAGLS3 is set to 2. FLAGLS3=2 means that the KO2 value is being decreased by a fixed value ΔLS3.

In order that the KO2 value is decreased by ΔLS3 each time the predetermined number nO2 of the TDC signal pulses have been generated, it is determined at step 25 whether or not the count value NO2 is zero. If the answer is No, the count value NO2 is reduced by one (step 27) and then the program is terminated. If the answer is Yes, then the KO2 value is decreased by ΔLS3 (step 26), and NO2 is reset to nO2 (step 28). It is then determined whether or not the KO2 value has been decreased to a value smaller than or equal to KO2LLM (step 29). If the answer is No, the program is terminated. Thereafter, until KO2<KO2LLM is satisfied, the program will repeatedly execute steps 33, 25, 28, and 29. When the KO2value has been decreased to KO2LLM, then FLAGLS3 is set to 3 to indicate that the equality KO2=KO2LLM is established (step 30), and the coefficient KO2 is set to the target value KO2LLM (step 31). Then, the target value KO2LLM is substituted for KO2 in the equation (1) to thereby calculate the fuel injection period TOUT. In this way, the air-fuel ratio is controlled to the final lean value appropriate to the region III. By virtue of the above described air-fuel ratio control in the region III, the engine can be operated in a low-load high-speed cruising condition with reduced fuel consumption and without a degration in the driveability, while controlling the air-fuel ratio to a value at which the NOx concentration is much smaller than the maximum level.

Incidentally, since the KO2 value has been set to KO2LLM at step 31 with the flag FLAGLS3 set to 3 as noted above, the step 33 in the next loop will provide a negative answer (No) whereby the equality KO2=-KO2LLM is maintained.

Next, the control manner according to steps 34 through 41 will be explained, which steps are executed when the engine is determined not to be operating in the mixture-leaning region III. First, at step 34 it is determined whether or not the engine is operating in another mixture-leaning region, i.e. in the region I or II. If the answer is Yes, the program proceeds to step 35 to determine whether or not the present value of FLAGLS3 is 2 or greater, i.e. whether or not the engine was in the mixture-leaning region III and was controlled in an open loop manner during the immediately preceding loop. If the answer is Yes, the program proceeds to step 36 to set the count value TDLS of the TDLS timer to zero and then proceeds to step 37, while if the answer is No, the program directly goes to step 37 skipping step 36. At step 37 the flag FLAGLS3 is set to zero and thereafter the air-fuel ratio is leaned in an open loop manner (KLS Loop) (step 38). In the step 38 the mixture-leaning coefficient KLS is set to either one of the predetermined values XLS1 and XLS2, depending on whether the engine is operating in the mixture-leaning region I or II. If the answer at step 34 is No, it is judged that the engine is operating in a region other than the mixture-leaning regions I, II, III, and then the program executes step 39 to set FLAGLS3 to zero and execute step 40 to set the count value TDLS of the TDLS timer to the predetermined time period tDLS (e.g. 0.5 seconds). Thereafter step 41 is executed so that the air-fuel ratio is controlled to a value appropriate to the other region in which the engine is operating.

The reason for setting the count value TDLS of the TDLS timer to zero at step 36 is to prohibit at steps 13 and 15 the calculation of the average value KO2AVE for the predetermined time period TDLS after the engine enters the region III, when the engine enters the region III from a region other than the mixture leaning regions I, II, III, e.g. the feedback operating region directly or by way of the region I or II, while the reason for resetting the value TDLS to the value tDLS is to immediately execute the calculation of the average value KO2AVE at steps 17 through 19 when if the engine temporarily enters the region I or II from the region III and then returns to the region III.

As explained above, according to the method of the present invention, when the engine enters the mixture-leaning region III (FIG. 3) which corresponds to a low-load high speed cruising condition, the air-fuel ratio is initially controlled in feedback manner alone for the predetermined time period TDLS, and after the lapse of the time period TDLS, while the feedback control is continued, the target value KO2LLM of the coefficient KO2 to be applied in the region III is obtained by multiplying the average value KO2AVE of the coefficient KO2, which is determined in response to the output signal from the O2 sensor 15, by the mixture-leaning coefficient XLS3, so that the air-fuel ratio of the mixture is accurately controlled to a desired lean value (e.g. 18.0) appropriate to the region mixture-leaning region III while the engine is in the region III, whereby the driveability and emission characteristics are improved, respectively, at transition to the low-load high speed cruising and during same.

Figure 6:
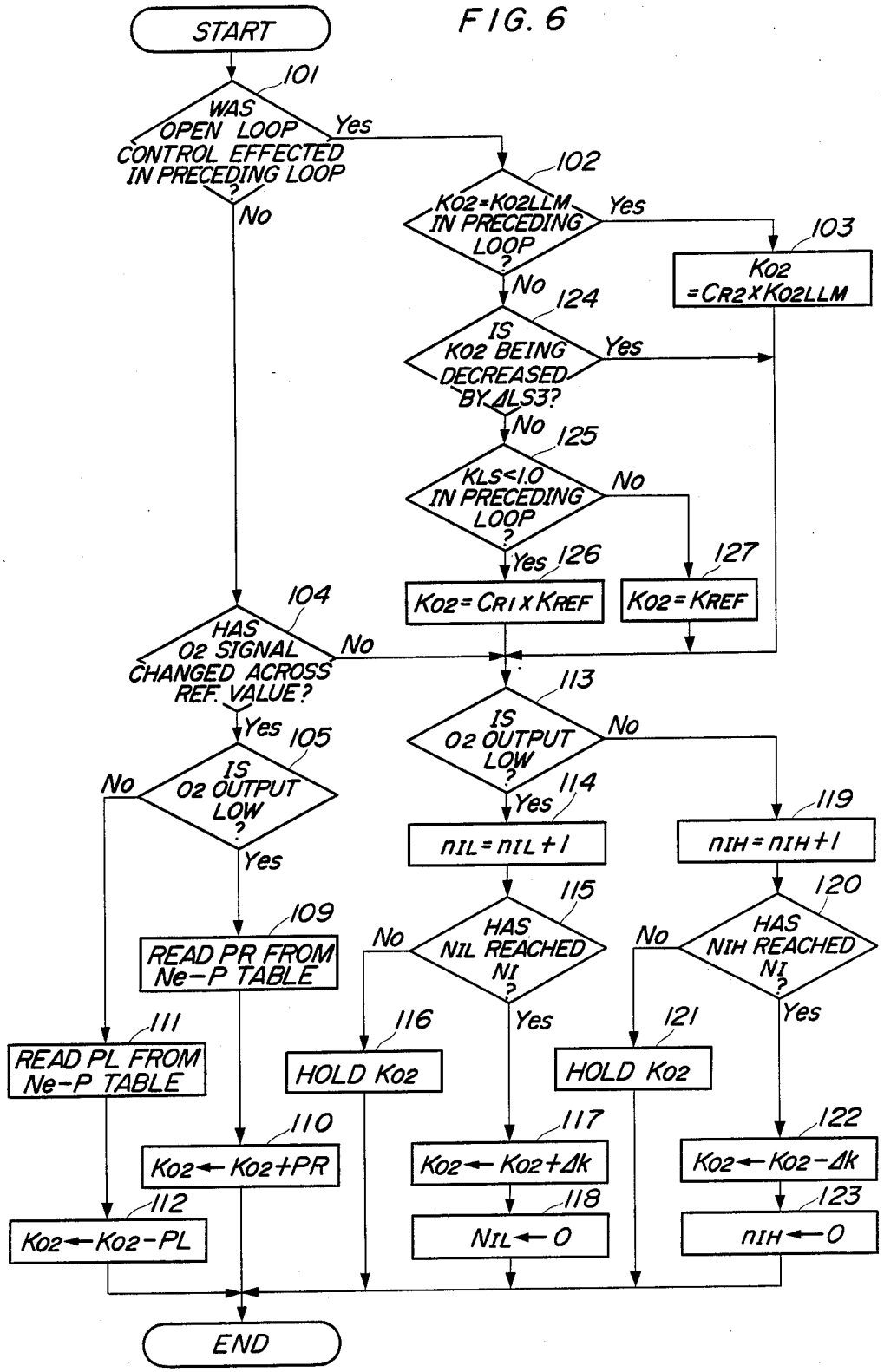
FIG. 6 is a flowchart of a program of executing the air-fuel ratio control method according to the invention.

On the other hand, when the engine operating condition shifts from the region III to the feedback control region, a process according to the flowchart shown in FIG. 6 is executed in synchronism with generation of the TDC signal. More specifically, it is determined at step 101 whether or not an open loop control was effected in the immediately preceding loop, and if the answer is affirmative (Yes), it is determined at step 102 whether or not the KO2 value as of the immediately preceding loop is equal to the target value KO2LLM determined when the engine operating condition was in the region III. If the answer to the question of step 102 is Yes, the initial value of KO2 is set to the product of KO2LLM and the predetermined enriching coefficient CR2 at step 103, followed by execution of steps 113 through 118 wherein the value of Ko2 is increased by the fixed value Δk from its initial value at step 117 (refer to FIG. 4).

If the answer to the question of step 102 is No, i.e. if the correction coefficient KO2 set in the immediately preceding loop is being either decreased by the fixed value ΔLS3or increased by the fixed value Δk, then the program procees to step 124, where the answer to the question will be Yes in the former case, and No is the latter case. If yes, the program proceeds to step 113, and if No, to step 125 to determined whether the mixture-leaning coefficient KLS applied in the immediately preceding loop is smaller than 1.0. If the answer to the question of step 125 is Yes, it means that the engine operating condition has shifted from either one of the mixture-leaning regions I and II to the feedback control region so that the mixture-leaning coefficient KLS has been set to XLS1 in the mixture-leaning region I or to XLS2 in the mixture-leaning region II. In this case the program proceeds to step 126 where the correction coefficient KO2 is set to the product of the enriching coefficient CR1 and the mean value KREP. If the answer to the question of step 125 in No, i.e. if the mixture-leaning coefficient KLS is equal to 1.0, this means the engine operating condition has shifted from an open loop control region, e.g. a WOT region, other than the mixture-leaning regions. In this case the program proceeds to step 127 where the KO2 value is set to the mean value KREF, and then step 113 is executed.

Now, if the answer to the question of step 102 is No, it is determined at step 104 whether or not the value of the output signals from the O2 sensor has changed across a predetermined reference value. If the answer is Yes, so-called proportional control (P term control) is effected in accordance with steps 105 and its succeeding steps, detailed description of which is omitted.

If the answer to the question of step 104 is No, i.e. if the value of the output signal from the O2 sensor has not changed across the predetermined reference value, so-called integral control (I term control) is effected. More specifically, it is determined at step 113 whether or not the value of the output signal from the O2 sensor is smaller than the predetermined reference value. If the answer is Yes, then at step 114 a TDC signal pulse count value NIL as of the immediately preceding TDC signal is increased by 1, and then at step 115 it is determined whether or not the count value NIL has reached the predetermined value NI (e.g. 30). If the answer to the question of step 115 is No, the coefficient KO2 is held at its present value and applied in the calculation of TOUT. If it is determined at step 115 that the value NIL has reached NI, then at step 117 the value of KO2 is increased by Δk (e.g. Δk is 0.3% of KO2). Then, at step 118 the pulse count value NIL is reset to zero, whereupon the program terminates. In this way, each time the program executes steps 114 through 117 the KO2 value is increased by the fixed value Δk.

If the answer to the question of step 113 is No, the program proceeds to step 119 where a TDC signal pulse count value NIH as of the immediately preceding TDC signal is increased by 1. Then, at step 120 it is determined whether or not the value NIH has reached the predetermined value NI, and if the answer is No, the coefficient KO2 is held at its present value and applied in the calculation of TOUT. If at step 120 the answer is Yes, then at step 122 the value of KO2 is decreased by Δk, and the program terminates after resetting the TDC signal pulse count value NIH to zero (step 123). Similarly as above, each time the program executes steps 119 through 122 the KO2 value is decreased by the fixed value Δk.

Incidentally, according to the method of the present invention, immediately after the engine operating condition has shifted from the mixture-leaning region III to the feedback control region the actual air-fuel ratio is leaner than the stoichiometric mixture ratio due to the application of the target value KO2LLM to the air-fuel ratio control in the region III, the answer to the question of step 113 should become Yes, and therefore the addition of Δk will then be repeated until the air-fuel ratio reaches the stoichiometric mixture ratio (step 117).

In the above described manner, when the engine operating condition shifts from the feedback control region to the low-load operating region III, and vice versa, the air-fuel ratio of the air-fuel mixture supplied to the engine is gradually increased and decreased, respectively, so that a sudden change in engine torque attributable to a sudden change in the engine output is prevented at the time of shifting, whereby the driveability is improved. Particularly, in the case of engine operating condition shifting from the low-load operating region III to the feedback control region, since the initial value of the air-fuel ratio correction coefficient KO2 is set to the product of the value KO2LLM obtained immediately before the shifting and the predetermined enriching coefficient CR2, the shifting of the engine operating condition to the feedback control region can occur promptly to thus prevent degradation in the driveability as well as that in the emission characteristics.

What is claimed is:

1. A method of effecting feedback control of the air-fuel ratio of an air-fuel mixture being supplied to an internal combustion engine having an exhaust passage and means arranged in said exhaust passage for detecting the concentration of an exhaust gas ingredient, to a first predetermined value, by correcting a basic fuel supply quantity by the use of a correction coefficient variable in value in response to an output from said means for detecting the exhaust gas ingredient concentration, when said engine is operating in a predetermined feedback control region, the method comprising the steps of: (1) providing a low-load operating region of said engine lying outside said predetermined feedback control region and defined by at least one parameter representing load on said engine; (2) gradually decreasing said correction coefficient until the air-fuel ratio of said air-fuel mixture is increased to a second predetermined value which is leaner than said first predetermined value, when the engine enters said predetermined low-load operating region; (3) when the engine enters said predetermined feedback control region from said predetermined low-load operating region, setting an initial value of said correction coefficient to the product of a value of said correction coefficient obtained immediately before the engine enters said predetermined feedback control region and a predetermined enriching coefficient; and (4) gradually increasing said initial value of said correction coefficient until the air-fuel ratio of said air-fuel mixture is decreased to said first predetermined value.

2. A method as claimed in claim 1, wherein in said step (4) said initial value of said correction coefficient is decreased by a fixed value each time a predetermined number of pulses of a signal representing predetermined crank angles of said engine are generated and until the air-fuel ratio of said air-fuel mixture becomes equal to said first predetermined value.

3. A method as claimed in claim 1, wherein in said step (2) the value of said correction coefficient is gradually decreased to a target value which yields a predetermined air-fuel ratio richer than a stoichiometric mixture ratio, and said step (3) is executed to set said initial value of said correction coefficient to the product of said value of said correction coefficient obtained immediately before the engine enters said predetermined feedback control region and said predetermined enriching coefficient only when said value of said correction coefficient obtained immediately before said engine enters said predetermined feedback control region is equal to said target value.

4. A method as claimed in claim 3, wherein if said correction coefficient has not been decreased to said target value in said step (2) by the time said engine enters said predetermined feedback control region from said predetermined low-load operating region, said initial value of said correction coefficient is set to said value of said correction coefficient obtained immediately before said engine enters said predetermined feedback control region.

5. A method as claimed in claim 1, wherein said predetermined low-load operating region is a low-load high speed operating region in which the speed of a vehicle in which said engine is installed is higher than a predetermined value.

* * * * *